US007307547B2

(12) United States Patent
Schwartz

(10) Patent No.: US 7,307,547 B2
(45) Date of Patent: Dec. 11, 2007

(54) TRAFFIC PREEMPTION SYSTEM SIGNAL VALIDATION METHOD

(75) Inventor: Mark A. Schwartz, River Falls, WI (US)

(73) Assignee: Global Traffic Technologies, LLC, Oakdale, MN (US)

( * ) Notice: Subject to any disclaimer, the term of this patent is extended or adjusted under 35 U.S.C. 154(b) by 103 days.

(21) Appl. No.: 11/142,013

(22) Filed: Jun. 1, 2005

(65) Prior Publication Data

US 2006/0273924 A1 Dec. 7, 2006

(51) Int. Cl.
*G08G 1/095* (2006.01)

(52) U.S. Cl. ..... 340/907; 340/906; 340/924; 701/117

(58) Field of Classification Search ..... 340/907, 340/906, 908, 436, 909, 910, 911, 924, 902, 340/991, 992, 993; 701/201, 213, 202, 207, 701/208, 117

See application file for complete search history.

(56) References Cited

U.S. PATENT DOCUMENTS

| | | | |
|---|---|---|---|
| 3,550,078 | A | 12/1970 | Long |
| 3,831,039 | A | 8/1974 | Henschel |
| 4,162,447 | A | 7/1979 | Teshirogi et al. |
| 4,162,477 | A | 7/1979 | Munkberg |
| 4,228,419 | A | 10/1980 | Anderson |
| 4,230,992 | A | 10/1980 | Munkberg |
| 4,234,967 | A | 11/1980 | Henschel |
| 4,463,339 | A | 7/1984 | Frick et al. |
| 4,680,811 | A | 7/1987 | Harper et al. |
| 4,704,610 | A | 11/1987 | Smith et al. |
| 4,717,913 | A | 1/1988 | Elger |
| 4,727,600 | A | 2/1988 | Avakian |
| 4,734,881 | A | 3/1988 | Klein et al. |
| 4,914,434 | A | 4/1990 | Morgan et al. |
| 4,970,439 | A | 11/1990 | Stopa |
| 4,972,185 | A | 11/1990 | Stopa et al. |
| 4,992,790 | A | 2/1991 | Montgomery |
| 5,014,052 | A | 5/1991 | Obeck |
| 5,159,480 | A | 10/1992 | Gordon et al. |
| 5,172,113 | A | 12/1992 | Hamer |
| 5,187,373 | A | 2/1993 | Gregori |
| 5,187,476 | A | 2/1993 | Hamer |
| 5,202,683 | A | 4/1993 | Hamer et al. |

(Continued)

OTHER PUBLICATIONS

Special Provisions For Purchase of Emergency Vehicle Preemption Equipment, City of Rochester, Minnesota; City Project 9955 (J-6396) S.P. 8826-18 dated May 29, 2003, 13 pages, p. 9 of 10, Section 4 (TR2).

"Strobecom II, Optical Preemption and Priority Control System", http://www.tomar.com/strobecom/index.htm, 3, pages. Printed from Internet Feb. 8, 2005.

(Continued)

*Primary Examiner*—Anh V. La
(74) *Attorney, Agent, or Firm*—Schwegman, Lundberg & Woessner, P.A.

(57) ABSTRACT

A secure optical-communication traffic-preemption system and method is provided that securely communicates an identification code from an optical emitter to a traffic location. The optical emitter transmits light pulses that represent an encrypted code that is an encryption using a time-varying encryption key of at least an identification code. An optical detector situated at a traffic location receives the transmitted light pulses. Validation, including decryption using a time-varying decryption key, is attempted for the encrypted identification code represented within the received light pulses. In response to validating the included identification code, a traffic-preemption command is generated for a traffic light at the traffic location.

26 Claims, 3 Drawing Sheets

U.S. PATENT DOCUMENTS

| | | | | |
|---|---|---|---|---|
| 5,519,389 | A | 5/1996 | DeGunther et al. | |
| 5,539,398 | A | 7/1996 | Hall et al. | |
| 5,602,739 | A | 2/1997 | Haagenstad et al. | |
| 5,926,113 | A | 7/1999 | Jones et al. | |
| 5,986,575 | A | 11/1999 | Jones et al. | |
| 6,243,026 | B1 | 6/2001 | Jones et al. | |
| 6,281,808 | B1 * | 8/2001 | Glier et al. | 340/933 |
| 6,429,812 | B1 * | 8/2002 | Hoffberg | 342/357.1 |
| 6,621,420 | B1 * | 9/2003 | Poursartip | 340/907 |

OTHER PUBLICATIONS

Tomar Electronics, "Strobecom II", System Manual (Rev 3), Jun. 2000, 25 pages.

Tomar Electronics, "Strobecom II. Optical Signal Processor Configuration Software (OSPsoft)," User's Manual, Version 2.0 for use with OSP Version 2.0, May 2000, 40 pages.

"Elock™ Emitter Authenticator," http://www.tomar.com/products/elock/elock.htm, 11 pages. Printed from Internet Apr. 27, 2005.

* cited by examiner

TRAFFIC PREEMPTION SYSTEM SIGNAL VALIDATION METHOD

FIELD OF THE INVENTION

The present invention is generally directed to systems and methods that allow traffic light systems to be remotely controlled using high-integrity data communication, for example, involving optical pulse transmission from an optical emitter to an optical detector that is communicatively-coupled to a traffic light controller at an intersection.

BACKGROUND OF THE INVENTION

Traffic signals have long been used to regulate the flow of traffic at intersections. Generally, traffic signals have relied on timers or vehicle sensors to determine when to change the phase of traffic signal lights, thereby signaling alternating directions of traffic to stop, and others to proceed. This situation is commonly exemplified in an emergency-vehicle application.

Emergency vehicles, such as police cars, fire trucks and ambulances, are generally permitted to cross an intersection against a traffic signal. Emergency vehicles have typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

There are presently a number of known optical traffic priority systems that permit for a fixed code to be embedded into the data stream to identify each vehicle and provide security. Such a code can be compared to a list of authorized codes at the intersection to restrict access by unauthorized users. This approach can be disadvantageous for certain applications or environments. For example, one problem with this approach arises when the transmitted data protocol is generally known or can easily be intercepted and re-created by unauthorized users. Once the transmitted data has been decoded or the transmitted data has been recorded for future playback, an unauthorized device can be used to activate the system. In addition, an unauthorized device can be used to activate the system without intercepting any transmitted data by attempting to activate the system using various codes until a code is discovered that successfully activates the system.

There are some straight-forward approaches for preventing such unauthorized access to the traffic light control systems. One approach is to remove any such intercepted or discovered code from the system database altogether. Coordination of such removal, however, can be burdensome and expensive since the vehicle code and the authorized code list at each intersection would need to be changed. Another approach is to prevent the unauthorized use by equipping all authorized vehicles, as well as the intersection (traffic light control) systems, with special communication transceivers that interact to provide another layer of security before providing access to the traffic light control systems. This approach can also be burdensome and expensive since each of the vehicles, as well as the systems at each intersection, would need additional equipment.

SUMMARY OF THE INVENTION

The present invention is directed to overcoming the above-mentioned challenges and others that are related to the types of approaches and implementations discussed above and in other applications. The present invention is exemplified in a number of implementations and applications, some of which are summarized below.

In connection with one embodiment, the present invention is directed to implementations that allow traffic light systems to be remotely controlled using high-integrity data communication. One such implementation employs optical encrypted data being transmitted to traffic light control equipment located at an intersection.

In a more particular example embodiment, a secure optical-communication traffic-preemption system includes an optical emitter and a traffic light circuit. The optical emitter is adapted to transmit light pulses that represent an encrypted code that is an encryption using a time-varying encryption key including at least an identification code. The traffic light circuit has an optical detector located at a traffic location and adapted to receive the transmitted light pulses, and has a decoding circuit adapted to respond to the received light pulses by attempting to validate the included identification code. In response to validating the included identification code, a traffic-preemption command is generated for a traffic light at the traffic location.

In another more particular example embodiment, a method is provided for securely communicating an operation identification code to a traffic location in an optical-communication traffic-preemption system. The operation identification code is encrypted using a time-varying encryption key. Light pulses are transmitted from an optical emitter, with the light pulses representing the operation identification code that is encrypted. The light pulses are received at an optical detector situated at the traffic location. The received encrypted operation identification code is decrypted using a time-varying decryption key and the decrypted operation identification code is validated.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the detailed description of various embodiments of the invention in connection with the accompanying drawings, in which.

Figure 1:
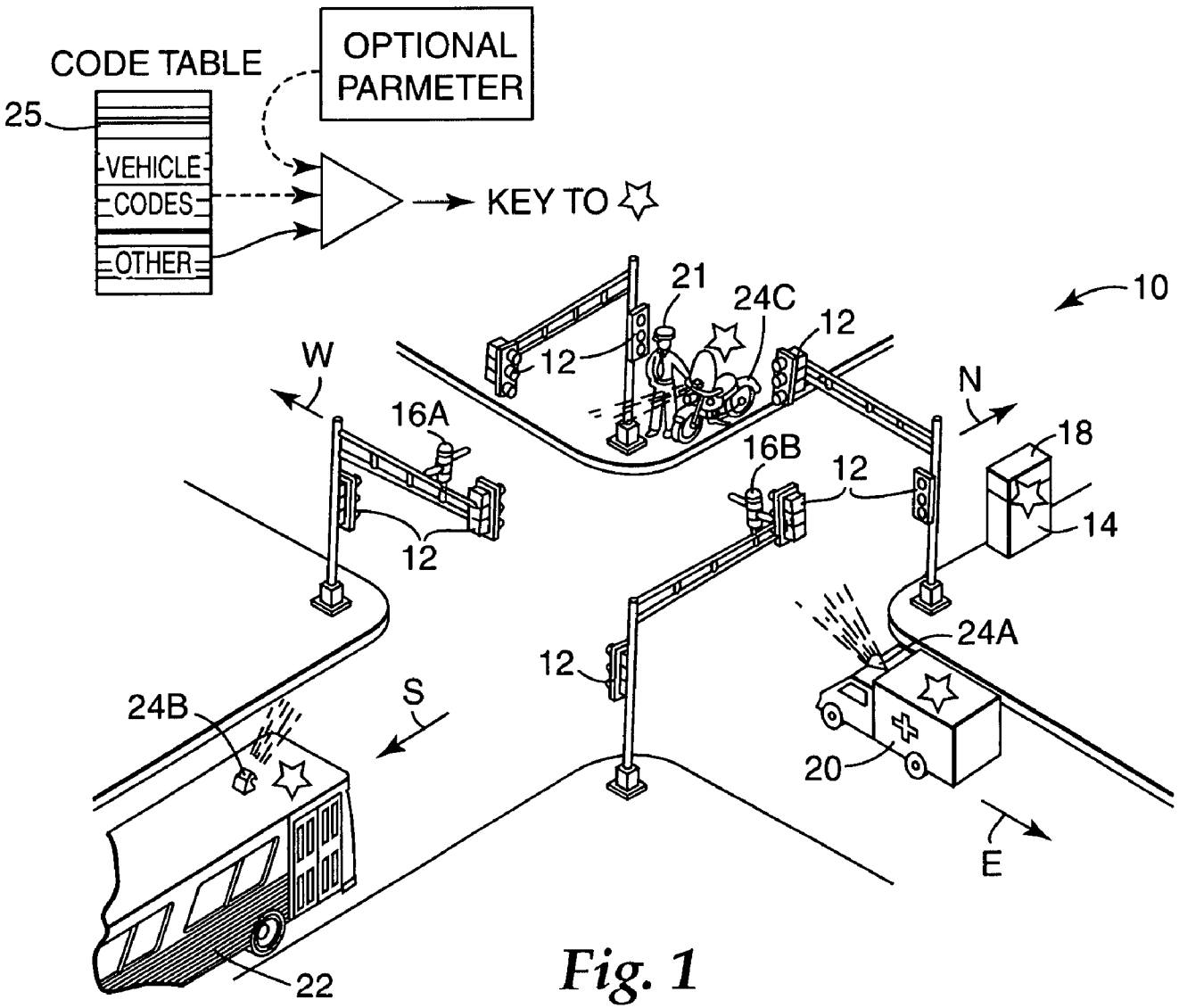
FIG. 1 is a perspective view of a bus and an ambulance approaching a typical traffic intersection, with emitters mounted to the bus, the ambulance and a motorcycle each transmitting an optical pulses in accordance with the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION OF THE EMBODIMENTS

The present invention is believed to be applicable to a variety of different types of validation of operation requests in an optical traffic preemption system. While the present invention is not necessarily limited to such approaches, various aspects of the invention may be appreciated through a discussion of various examples using these and other contexts.

The optical traffic preemption system shown in FIG. 1 is presented at a general level to show the basic circuitry used to implement example embodiments of the present invention. In this context, FIG. 1 illustrates a typical intersection 10 having traffic lights 12. A traffic signal controller 14 sequences the traffic lights 12 through a sequence of phases that allow traffic to proceed alternately through the intersection 10. The intersection 10 is equipped with an optical traffic preemption system having certain aspects and features enabled in accordance with the present invention to provide secure communication in an efficient, flexible and practicable manner.

This secure communication is provided in the optical traffic preemption system of FIG. 1 by way of optical emitters 24A, 24B and 24C, detector assemblies 16A and 16B, and a phase selector 18. The detector assemblies 16A and 16B are stationed to detect light pulses emitted from authorized vehicles approaching the intersection 10. The detector assemblies 16A and 16B communicate with the phase selector 18, which is typically located in the same cabinet as the traffic controller 14, and which differentiates between authorized vehicles and unauthorized vehicles using a high-integrity, yet practicable approach.

In FIG. 1, an ambulance 20 and a bus 22 are approaching the intersection 10. The optical emitter 24A is mounted on the ambulance 20 and the optical emitter 24B is mounted on the bus 22. The optical emitters 24A and 24B each transmit a stream of light pulses. The stream of light pulses can transport codes that identify a requested command or operation. The detector assemblies 16A and 16B receive these light pulses and send an output signal to the phase selector 18. The phase selector 18 processes and validates the output signal from the detector assemblies 16A and 16B. Using a particular validation process, for certain validated output signals, the phase selector 18 issues a traffic preemption command to the traffic signal controller 14 to preempt the normal operation of the traffic lights 12.

In various embodiments, secure communication is provided by encrypting the operation identification code before transmission by the optical emitter 24A and 24B and recovering the operation identification code at the phase selector 18 by decrypting the encrypted operation identification code. Validation of the operational identification code by the phase selector 18 can include the decryption and additional validation approaches.

FIG. 1 also shows an authorized person 21 operating a portable optical emitter 24C, which is there shown mounted to a motorcycle 23. In one embodiment, the emitter 24C is used to set in phase selector 18 a validation algorithm and/or a validation key that checks for proper authorization, both of which can be used in connection with the validation process of the system. Typically, configuration of each phase selector 18, including setting the validation algorithm and validation key, is manually perform by authorized maintenance personnel. In another embodiment, the emitter 24C is used by the authorized person 21 to affect the traffic lights 12 in situations that require manual control of the intersection 10.

In various embodiments, emitters 24A, 24B and 24C include an encryption algorithm and an encryption key, and phase selector 18 includes a validation algorithm and a validation key. In one embodiment, the encryption and validation keys can be a shared symmetric encryption/decryption key. In another embodiment, emitters 24A, 24B and 24C can share an encryption key and phase selector 18 can have the corresponding decryption key for the validation key, such as in public key encryption. In one embodiment, the encryption algorithm encrypts data that includes the identification code of the requested command or operation and the encrypted data is transmitted from emitters 24A, 24B and 24C in the stream of light pulses. In another embodiment, the identification code of the requested command or operation is transmitted unencrypted along with a validation code that can be generated from the requested command or operation using the encryption algorithm and encryption key. The validation algorithm and validation key are used by the phase selector 18 to prevent unauthorized usage, such as an attempt by an unauthorized emitter 24D to control the intersection 10.

In contrast to a typical application for secure communication, a preemption request can be transmitted continuously by an emitter 24A or 24B and the preemption request should be recognizable by the phase selector 18 regardless of when reception at a detector assembly 16A or 16B begins. A preemption request can include a specific vehicle identification code that is transmitted continuously by emitters 24A during the emergency travel of vehicle 20 or by emitter 24B during the scheduled operation of vehicle 22. Reception of the preemption request can begin when an emitter 24A or 24B comes into range of a detector assembly 16A or 16B at intersection 10. Typically, existing systems recognize a received preemption request after two complete repetitions of the vehicle identification code are received.

Because an emitter 24A or 24B can repeatedly transmit a preemption request that is a short message and the preemption request should be quickly recognizable by phase selector 18 beginning at any point, the preemption request is especially vulnerable to unauthorized usage, including unauthorized duplication of the preemption request. A typical encryption scheme is deficient because recognition is not possible beginning at any point and/or playback of a recorded transmission defeats the encryption.

Various embodiments of the invention provide secure communication of preemption requests without increasing the response time of the phase selector 18. Secure communication of a preemption request is provided using the limited amount of encryption state that can be included in the preemption request and using a time-varying encryption key that is synchronized or approximately synchronized with a time-varying decryption key. The time-varying keys can prevent unauthorized activation by playback of a recorded transmission after the keys are updated. Various embodiments of the invention can transfer the requested command or operation in a code with a fixed length (and in other embodiments with a protocol-defined variable length) from emitters 24A, 24B and 24C to detector assemblies 16A and 16B. Example operation identification codes include a vehicle identification code of a preemption request and a code to download information from an emitter 24C to phase selector 18. For a request to preempt the normal operation of the traffic lights 12, the code can be repeated continuously during transmission from emitters 24A and 24B to ensure initiation of preemption as soon as an emitter 24A or 24B comes into range of the intersection 10. For an operation that does not require a time-critical response from the phase selector 18, the code can vary during transmission to allow more information to be transferred from emitters 24A, 24B and 24C to detector assemblies 16A and 16B. For example, an operation to download information from an emitter 24C to phase selector 18 can begin with a download command in a first code in the stream of light pulses followed by the information to be downloaded in subsequent codes in the stream of light pulses.

In a related embodiment, the requested command or operation can be transmitted in a code from emitters 24A, 24B and 24C to detector assemblies 16A and 16B, for initiating a higher-speed optical communication. For example, where optically-coded data is typically transmitted at about 10-15 Hz, the higher-speed optical communication is provided at a rate that is at least an order of magnitude higher. This higher-speed communication is implemented by both the transmitter and receiver circuitry to permit larger amounts of data to be downloaded at each traffic intersection for installing a new or modified computer-executable program module, new feature, algorithm, block-out vehicle codes, and/or enabling an already-present feature. While the present invention also contemplates downloading such upgrade-directed data using other communication tools (e.g., wired or wireless communication circuitry communicatively coupled via the external data port 43 of FIG. 2), this higher-speed optical communication approach provides a more particular degree of control over the upgrade process at an intersection-by-intersection basis. In addition, such an upgrade process permits the features upgraded at each intersection to be tested relative to default operation otherwise prevailing at both the upgraded intersection(s) and the non-upgraded intersection(s).

In one embodiment, the codes that can potentially be encrypted and transferred from emitters 24A, 24B and 24C to detector assemblies 16A and 16B can be subdivided into various ranges. For example, a code with a fixed width of 14-bits has 16,384 potential values, and these codes can be subdivided into 10,000 vehicle identification codes and 6384 other "special" codes, as shown at code table 25. A value of zero can correspond to a default vehicle identification code that is not associated with any particular vehicle. The vehicle identification codes can be transmitted by emitters 24A, 24B and 24C to request preemption of the traffic lights 12. Following validation of the vehicle identification code by the phase selector 18, the phase selector can issue a traffic preemption command to the traffic signal controller 14 to select a particular phase of the traffic lights 12. The special codes can be used to command other operations, including a command to download a decryption key to phase selector 18 from emitter 24C.

In one embodiment, transmission of an unencrypted vehicle identification code alternates with transmission of a special code that validates the vehicle identification code. Because the vehicle identification codes and the special validation codes are in different ranges, the phase selector 18 can readily distinguish the vehicle identification code from the validation code. The validation algorithm can use the received vehicle identification code, the validation code, the validation algorithm, and the validation key to determine proper authorization.

In another embodiment, the vehicle identification code is transmitted repeatedly by an emitter 24A with an encryption that varies for each transmission of the vehicle identification code. Thus, the data that is encrypted does not vary between transmissions, but the encryption does vary between transmissions. For an example of 14-bit width data values, a pseudo-random number generator can generate a 14-bit number each cycle using a 14-bit linear feedback shift register having feedback based on a prime polynomial. Such a pseudo-random number generator can generate every non-zero 14-bit number exactly once in a sequence before repeating the sequence after generating all the 16,383 non-zero 14-bit numbers. It will be appreciated that the pseudo-random sequence can readily be generated in software without a linear feedback shift register.

Each transmission including the vehicle identification code can be arranged to differ from the prior transmission by a bit-wise exclusive-or with a pseudo-random number from the sequence. Because the pseudo-random sequence does not include the value of zero, for backwards compatibility the absence of encryption can be indicated by successive identical transmitted values. In one approach, the data value including the vehicle identification code for each transmission is encrypted by a bit-wise exclusive-or between the data value and the value of a scramble register, and the value of the scramble register is updated for each transmission with an bit-wise exclusive-or between the next pseudo-random number in the sequence and the current value of the scramble register.

The phase selector 18 can receive two successive encrypted data values including the encrypted vehicle identification code and perform a bit-wise exclusive-or between the two successively received encrypted data values to determine the pseudo-random number in the sequence. As discussed below, the value of the pseudo-random number in the sequence can be used to determine the values of the scramble register used by the emitter 24A for each of the two encryptions for the successively received values, and these values of the scramble register can be used for decryption by a bit-wise exclusive-or. The unencrypted vehicle identification code from the two successive transmissions can be compared to validate proper decryption, and further validation can be performed using the unencrypted vehicle identification code.

After any sequence of the 16,383 pseudo-random numbers, the scramble register has a value that is the exclusive-or of the scramble register before the sequence and each of the 16,383 pseudo-random numbers, which are all the non-zero 14-bit numbers. The scramble register has the same value before and after the sequence. For example, 8,192 of these pseudo-random numbers are odd causing the least significant bit of the scramble register to be inverted an even number of times and the remaining 8,191 are even such that the least significant bit of the scramble register is unaffected. An even number of inversions causes the least significant bit of the scramble register to be the same before and after the sequence. Thus, given a particular initial value for the scramble register and a particular seed value for the pseudo-random number generator, the corresponding scramble register value can be determined from the pseudo-random number generated by the pseudo-random number generator. The keys and/or the validation algorithm may include the initial value for the scramble register, the seed for the pseudo-random number generator and the prime polynomial used by the pseudo-random number generator.

In yet another embodiment, a repeating cycle of values from a sequence, such as a pseudo-random sequence, is used to encrypt a vehicle identification code that is repeatedly encrypted and transmitted by an emitter 24A. The encrypted vehicle identification code can be transmitted by an emitter 24A within a transmitted data value that also includes a field identifying the position in the sequence of the value used for encryption. For example, a repeating cycle of eight values from a pseudo-random sequence can be successively used to encrypt a vehicle identification code. A three bit field transmitted unencrypted along with each encrypted vehicle identification code can be used by a phase selector 18 to determine the value from the pseudo-random sequence that was used to encrypt the vehicle identification code. Thus, the phase selector 18 can decrypt the vehicle identification code. The phase selector 18 can decrypt two successively received vehicle identification codes and compare these vehicle identification codes to verify proper decryption.

In an alternative embodiment, multiple data values can be encrypted and sequentially transferred from an emitter 24B to the phase selector 18 to increase the amount of information that may be transported. Each data value transferred can include a field identifying each of the plurality of values. For example, four data values may be transmitted and each data value may have an unencrypted 2-bit field identifying whether the data value is the first, second, third, or fourth data value. Thus, if the same four data values containing the information are repeatedly transferred, then phase selector 18 can successfully identify the individual data values and extract the information. For example, if an ambulance turns a corner at another intersection before approaching intersection 10, the first data value received by phase selector 18 may be the third data value. After successively receiving the fourth, first, and second data values, phase selector 18 can extract the information. The multiple data values can be used to transfer additional encryption information.

In one embodiment, each vehicle 20, 22, and 23 has a set of thumbwheel switches used by an administrator or operator for the vehicle to select a vehicle identification code for the vehicle from the codes of code table 25. In addition, the thumbwheel switches can be used to manually provide a key that is included in the encryption key for the optical emitter 24A, 24B, and 24C respectively mounted on vehicles 20, 22, and 23. For example, code table 25 can include 10,000 vehicle identification codes and 6384 special codes and selection of one of the 6384 special codes on the thumbwheel switches can update a value that is included in the encryption key. In one embodiment, such a special code from the thumbwheel switches of emitter 24C can be transferred by authorized person 21 using a manually initiated key download command to phase selector 18 for use in a decryption key.

In one embodiment, certain of the 6384 special codes or other command codes can be used to command update of the validation algorithm and validation key with an update value that is either encoded in the special code or provided by data values subsequent to the special code. For example, a phase selector 18 can implement three different validation algorithms and each validation algorithm can have a corresponding special code that enables the validation algorithm. Typically, any subsequent data values with the update value for the validation algorithm and/or validation key can use any data value within either the range for vehicle identification codes or the range for special codes. Generally, an update of the validation algorithm or validation key should pass any validation process currently in force and potentially additional layers of security before the update is accepted by the phase selector 18.

In another embodiment, optical emitter 24A, 24B, and 24C have a real-time clock. The date and/or time from the real-time clock or another time-based parameter or other natural parameter is used to select the encryption key used by the optical emitters 24A, 24B, and 24C. For example, a hash algorithm of the date and time, and potentially a manually updated key, can be used to generate an updated value for the encryption key every ten minutes. Thus, the optical emitters 24A, 24B, and 24C periodically change the encryption key automatically. Generally, any information used for encryption, other than the data value that is encrypted at an optical emitter 24A, 24B, and 24C and recovered at the phase selector 18, can be part of the encryption key. Similarly, any information used for decryption, other than the data value, can be part of the decryption key. The encryption and decryption keys can be dependent on a manually provided key, such as a key provided on thumbwheel switches and/or from a coupled portable computer, and/or the current date and time. The encryption and decryption keys can be manually updated, for example, in response to detection of unauthorized usage, and/or automatically updated based on the current data and time.

Upon passing authorization, phase selectors constructed in accordance with the present invention can be configured to use an identification code in various ways. In one configuration, the phase selector 18 is provided with a list of authorized identification codes providing an additional level of authorization. In this configuration, the phase selector 18 confirms that the vehicle is indeed fully authorized to preempt the normal traffic signal sequence. If the transmitted code does not match one of the authorized codes on the list, preemption does not occur.

In another configuration, the phase selector 18 logs all preemption requests by recording the time of preemption, direction of preemption, duration of preemption, identification code, confirmation of passage of a requesting vehicle within a predetermined range of a detector, and denial of a preemption request due to improper authorization. In this configuration, attempted abuse of an optical traffic preemption system can be discovered by examining the logged information.

In another embodiment of the present invention, an optical traffic preemption system helps run a mass transit system more efficiently. An authorized mass transit vehicle having an optical emitter constructed in accordance with the present invention, such as the bus 22 in FIG. 1, spends less time waiting at traffic signals, thereby saving fuel and allowing the mass transit vehicle to serve a larger route. This also encourages people to utilize mass transportation instead of private automobiles because authorized mass transit vehicles move through congested urban areas faster than other vehicles.

Unlike an emergency vehicle 20, a mass transit vehicle 22 equipped with an optical emitter may not require total preemption. In one embodiment, a traffic signal offset is used to give preference to a mass transit vehicle 22, while still allowing all approaches to the intersection to be serviced. For example, a traffic signal controller that normally allows traffic to flow 50 percent of the time in each direction responds to repeated phase requests from the phase selector to allow traffic flowing in the direction of the mass transit vehicle 22 to proceed 65 percent of the time and traffic flowing in the other direction to flow 35 percent of the time. In this embodiment, the actual offset can be fixed to allow the mass transit vehicle 22 to have a predictable advantage. Generally, proper authorization should be validated before executing an offset for a mass transit vehicle 22.

In a typical installation, the traffic preemption system does not actually control the lights at a traffic intersection. Rather, the phase selector 18 alternately issues phase requests to and withdraws phase requests from the traffic signal controller, and the traffic signal controller 14 determines whether the phase requests can be granted. The traffic signal controller 14 may also receive phase requests originating from other sources, such as a nearby railroad crossing, in which case the traffic signal controller 14 may determine that the phase request from the other source be granted before the phase request from the phase selector. However, as a practical matter, the preemption system can affect a traffic intersection 10 and create a traffic signal offset by monitoring the traffic signal controller sequence and repeatedly issuing phase requests that will most likely be granted.

According to a specific example embodiment, the traffic preemption system of FIG. 1 is implemented using a known implementation that is modified to implement the codes and algorithms discussed above for encryption and decryption. For example, an Opticom™ Priority Control System (manufactured by 3M Company of Saint Paul, Minn.) can be modified to implement the codes and algorithms discussed above for encryption and decryption. Consistent with features of the Opticom™ Priority Control System, one or more embodiments of U.S. Pat. No. 5,172,113 can be modified in this manner. Also according to the present invention, another specific example embodiment is implemented using another so-modified commercially-available traffic preemption system, such as the Strobecom II system (manufactured by TOMAR Electronics, Inc. of Phoenix, Ariz.).

Figure 2:
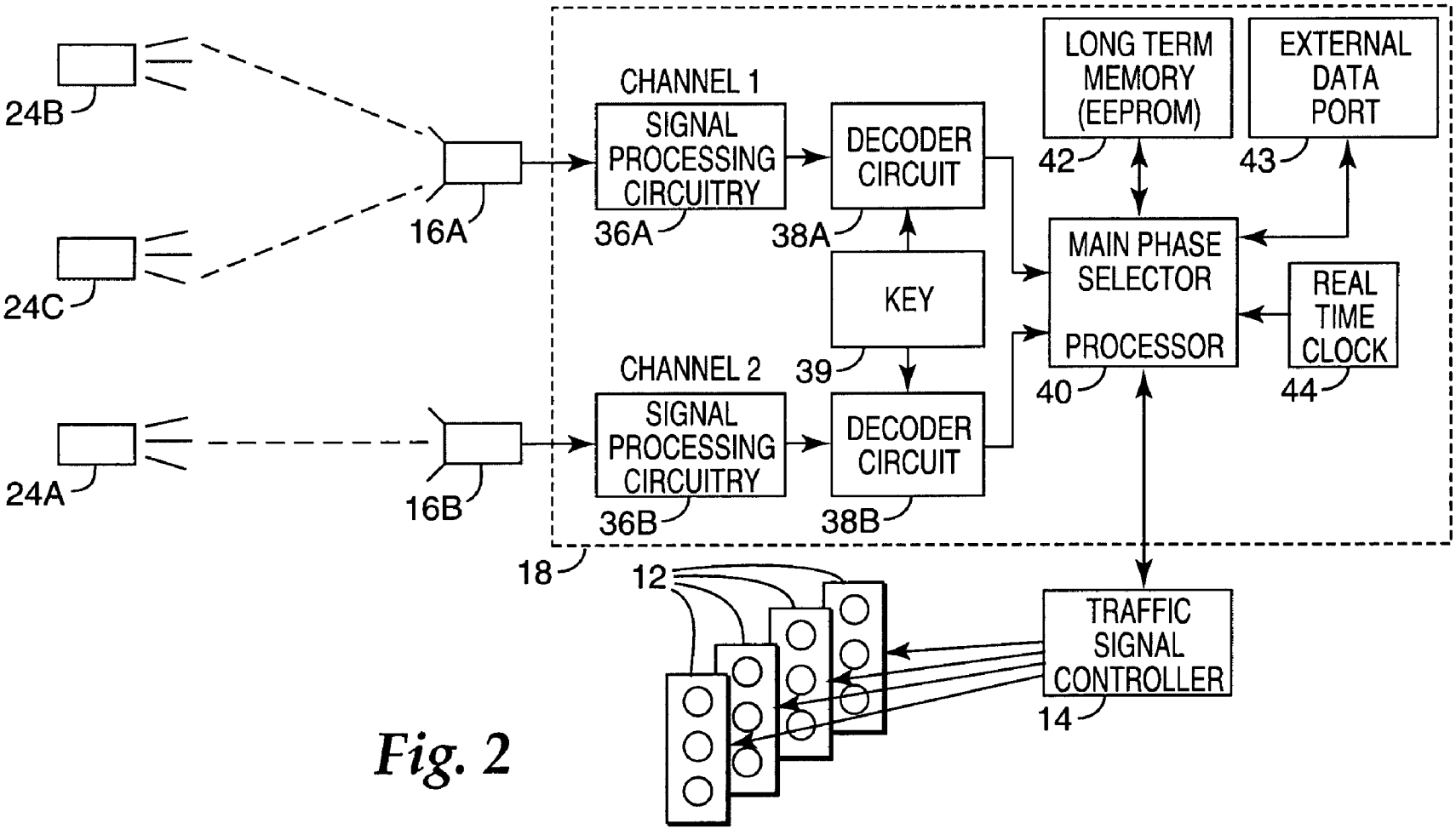
FIG. 2 is a block diagram of the components of the optical traffic preemption system shown in FIG. 1.

FIG. 2 is a block diagram showing the optical traffic preemption system of FIG. 1. In FIG. 2, light pulses originating from the optical emitters 24B and 24C are received by the detector assembly 16A, which is connected to a channel one of the phase selector 18. Light pulses originating from the optical emitter 24A are received by the detector assembly 16B, which is connected to a channel two of the phase selector 18.

The phase selector 18 includes the two channels, with each channel having signal processing circuitry (36A and 36B) and a decoder circuit (38A and 38B), a main phase selector processor 40, long term memory 42, an external data port 43 and a real time clock 44. The main phase selector processor 40 communicates with the traffic signal controller 14, which in turn controls the traffic lights 12.

With reference to the channel one, the signal processing circuitry 36A receives an analog signal provided by the detector assembly 16A. The signal processing circuitry 36A processes the analog signal and produces a digital signal that is received by the decoder circuit 38A. The decoder circuit 38A extracts data from the digital signal, validates proper authorization and provides the data to the main phase selector processor 40. Channel two is similarly configured, with the detector assembly 16B coupled to the signal processing circuitry 36B, which in turn is coupled to the decoder circuit 38B.

The long term memory 42 is implemented using electronically erasable programmable read only memory (EEPROM). The long term memory 42 is coupled to the main phase selector processor 40 and is used to store a list of authorized identification codes and to log data. It will be appreciated that keys 39 can be stored in long term memory 42.

The decoder circuits 38A and 38B use keys 39 to check for proper authorization. In one embodiment, a received vehicle identification code is decrypted using the decryption key and the resulting decrypted vehicle identification code is checked against a list of authorized identification codes from long term memory 42. In another embodiment, a received vehicle identification code and the decryption key is used to seed a pseudo-random number generator to produce a pseudo-random number that is compared with a validation code transmitted received along with the vehicle identification code. For proper authorization, the pseudo-random number should match the validation code and the received vehicle identification code should match an entry in a list of authorized identification codes from long term memory 42.

The external data port 43 is used for coupling the phase selector 18 to a computer. In one embodiment, external data port 43 is an RS232 serial port. Typically, portable computers are used in the field for exchanging data with and configuring a phase selector. Logged data is removed from the phase selector 18 via the external data port 43 and keys 39 and a list of authorized identification codes is stored in the phase selector 18 via the external data port 43. The external data port 43 can also be accessed remotely using a wired or wireless modem, local-area network or other such device.

Keys 39 can be updated from a portable computer via external data port 43. In addition, main phase selector processor 40 can update keys 39 in response to a command received from detector assemblies 16A and 16B to update the keys that has been validated for proper authorization by a decoder circuit 38A or 38B.

The real time clock 44 provides the main phase selector processor 40 with the actual time. The real time clock 44 provides time stamps that can be logged to the long term memory 42 and is used for timing other events, including timed update of the validation algorithm and/or keys 39. In one embodiment, the validation algorithm and values for keys 39 are selected from a list stored in memory 42 at specified times, such as once a day. In another embodiment, the validation algorithm and values for keys 39 are generated from the date and time or another time-based parameter provided by the real time clock 44 or another natural parameter. For example, a hash algorithm of the date, time, and/or a current value for manually provided key is used to periodically generate values automatically for keys 39. In yet another embodiment, the validation algorithm and keys 39 are updated with new values at a particular time, such as three in the morning of the day after receiving the new values for validation algorithm and values for keys 39.

In an alternative embodiment, the validation algorithm uses multiple validation keys. For example, real time clock 44 can be incompletely synchronized with a similar real time clock in each of emitters 24A, 24B and 24C and validation using two validation keys may compensate for validation keys that are periodically updated using incompletely synchronized real-time clocks. During a first half or other initial portion of the period for a validation key based on real-time clock 44, decoder circuits 38A and 38B can perform validation using the validation key and the prior validation key. Validation is successful if either validation attempt succeeds. During a second half or other final portion of the period for a validation key based on real-time clock 44, decoder circuits 38A and 38B can similarly perform validation using the validation key and the next validation key.

In various embodiments, the data transmitted by emitters 24A, 24B and 24C and received by detectors 16A and 16B is provided by interleaving the presence or absence of an optical pulse between pulses of a chain of pulses transmitted at a particular frequency. For example, the presence of an interleaved optical pulse can represent a binary one and the absence of an interleaved optical pulse can represent a binary zero. The particular frequency can determine a priority, such as a frequency of approximately 10 Hz for an emergency vehicle and a frequency of approximately 14 Hz for a mass transit vehicle.

In various other embodiments, the data transmitted by emitters 24A, 24B and 24C and received by detectors 16A and 16B is provided by transmitting a chain of pulses that either shifts or does not shift the nominal frequency of each pulse. For example, not shifting the nominal frequency of a pulse can correspond to one data value and shifting a specific pulse to a slightly higher or slight lower frequency relative to the nominal frequency can represent other data values. For example, not shifting the nominal frequency, shifting down the nominal frequency by one unit, shifting up the nominal frequency by one unit, and shifting up the nominal frequency by two units can correspond to data values for a pulse of zero, one, two, and three, respectively.

Figure 3:
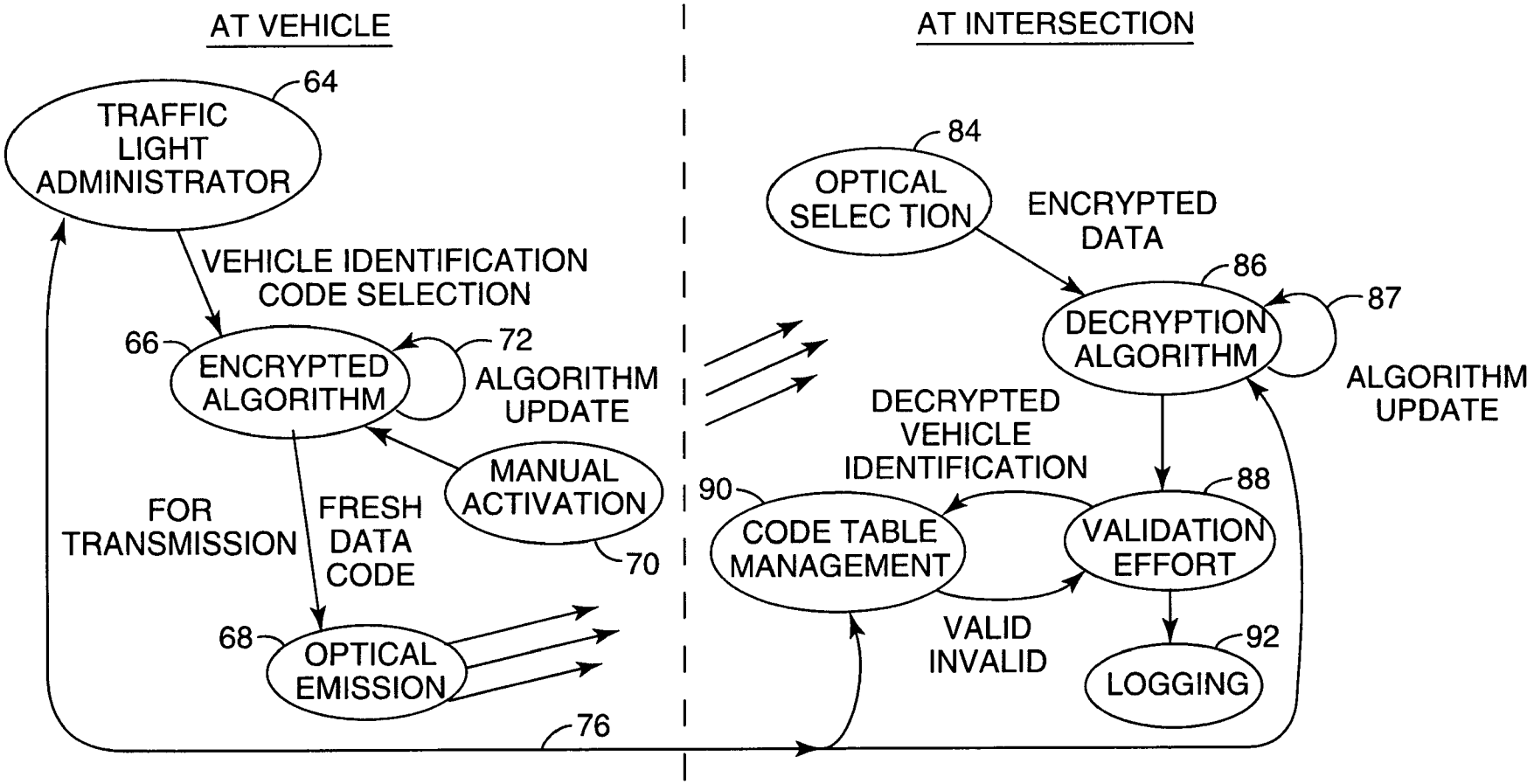
FIG. 3 is a flow diagram of the operation of the optical traffic preemption system at a vehicle and an intersection in accordance with the present invention.

FIG. 3 is a flow diagram of the operation of the optical traffic preemption system at a vehicle and an intersection in accordance with the present invention. As in FIG. 2, operation/activity of the equipment at the vehicle is shown at the left side of the illustration and operation/activity of the equipment at the intersection is shown at the right side of the illustration. At the vehicle, the operator of the vehicle or an agent of the system administrator selects the unique vehicle identification code for the vehicle (and its associated emitter equipment). Such an agent is shown at node 64, with a connecting data line showing the unique vehicle identification code being passed to the vehicle at activity node 66. The key for encrypting the vehicle identification code can be preinstalled in the vehicle, passed by the agent, and/or automatically changed as a function of a natural parameter (e.g., every second Tuesday of each month at 11:58 pm Central), as a function of an algorithm (per the updates at data lines 72 and 87), and/or as a function of an irregular parameter such as pseudo-random sequence identifying a time at which this key changes and/or the manner in which the key changes. Node 70 depicts another optional feature in which the encryption operation at node 66 is only enabled in response to a special enable command being manually entered. Each such manual data entry can be readily implemented using conventional touch keys or other types of switches for selecting the appropriate codes.

Once enabled and equipped with the appropriate code selection, the light pulse signaling can be emitted from the vehicle-installed equipment toward the equipment at the intersection, as shown at node 68. As shown at node 84, the light pulse signaling is detected at the intersection and a data signal is passed to node 86. Assuming that the vehicle identification code is authorized, the data signal includes the vehicle identification code as encrypted using the key selected as discussed above in connection with 25 of FIG. 1. At node 86, the received date is decrypted using the key and, if the key and/or algorithm has been updated (per line 87), using the updated information. Before phase selection, another data processing module validates the preemption attempt (node 88) by comparing the decrypted data signal (e.g., vehicle identification code) with authorized codes as stored at the code management table (node 90). The preemption attempt (whether or not successful) is logged (node 92) as is conventional in the above-discussed embodiments and commercial systems.

While certain aspects of the present invention have been described with reference to several particular example embodiments, those skilled in the art will recognize that many changes may be made thereto. For example, the optical emitter and detector circuitry, as well as the data signal processing (data look-up, data sending and formatting, and data en/decryption) can be implemented using a signal processing circuit arrangement including one or more processors, volatile and/or nonvolatile memory, and a combination of one or more analogy, digital, discrete, programmable-logic, semi-programmable logic, non-programmable logic circuits. Examples of such circuits for comparable signal processing tasks are described in the previously-discussed commercial devices and various references including, for example, U.S. Pat. Nos. 5,172,113; 5,519,389; 5,539,398; and 4,162,447. Such implementations and adaptations are embraced by the above-discussed embodiments without departing from the spirit and scope of the present invention, aspects of which are set forth in the following claims.

What is claimed is:

1. A secure optical-communication traffic-preemption system, comprising;

an optical emmitter adapted to transmit light pulses that represent an encrypted code that is an encryption using a time-varying encryption key of at least an identification code; and a traffic light circuit having an optical detector located at a traffic location and adapted to receive the transmitted light pulses, and a decoding circuit adapted to respond to the received light pulses by attempting to validate the included identification code and, in response to validating the included identification code, generate a traffic-preemption command for a traffic light at the traffic location.

2. The traffic-preemption system of claim 1, wherein the decoding circuit is further adapted to use a decryption key to recover the identification code.

3. The traffic-preemption system of claim 1, wherein the encrypted code is a function of a pseudo-random sequence generated from the time-varying encryption key.

4. The traffic-preemption system of claim 3, wherein the light pules further represent a position in a repeating cycle of the pseudo-random sequence.

5. The traffic-preemption system of claim 3, wherein the time-varying encryption key changes as a function of a natural parameter.

6. The traffic-preemption system of claim 5, wherein the natural parameter is time-based.

7. The traffic-preemption system of claim 5, wherein the natural parameter is algorithmically-based.

8. The traffic-preemption system of claim 1, wherein the light pulses further represent the identification code.

9. The traffic-preemption system of claim 1, wherein the decoding circuit is adapted to use a look-up table to validate the identification code.

10. The traffic-preemption system of claim 1, wherein the decoding circuit is adapted to log the success and failure of the attempt to validate the included identification code.

11. The traffic-preemption system of claim 1, wherein a key is manually implemented based on a recently-issued administration function, and the decoding circuit is adapted to use decryption based on the key to recover the identification code.

12. The traffic-preemption system of claim 1, wherein a key is automatically implemented by at least the decoding circuit.

13. The traffic-preemption system of claim 1, further including an encoding circuit, communicatively coupled to and providing the encrypted code to the optical emitter, wherein the time-varying encryption key is a time-varying symmetric key that is manually implemented by the encoding circuit based on a recently-issued administration function, and automatically implemented by and used by the decoding circuit to recover the identification code.

14. The traffic-preemption system of claim 13, wherein the time-varying symmetric key is automatically implemented by and used by the decoding circuit both to recover the identification code and to alter a manner in which the decoding circuit recovers the identification code.

15. The traffic-preemption system of claim 1, wherein the decoding circuit is further adapted to recover the identification code using two values for a decryption key that correspond to two successive values of the time-varying encryption key.

16. The traffic-preemption system of claim 1, wherein the optical emitter is mounted to a vehicle and the identification code is a vehicle identification code associated with the vehicle.

17. A detection arrangement of an optical-communication traffic-preemption system, comprising:

an optical detector located at a traffic location and adapted to receive transmitted light pulses from an optical emitter, the transmitted light pulses including an operation identification code that is encrypted using a time-varying encryption key; and a validation circuit coupled to the optical detector, the validation circuit adapted to store a time-varying decryption key, decrypt using the time-varying decryption key the operation identification code that is encrypted, and attempt to validate the operation identification code.

18. The detection arrangement of claim 17, wherein the operation identification code is a vehicle identification code and the validation circuit is further adapted to generate a phase request for traffic preemption at the traffic location in response to validating the vehicle identification code.

19. The detection arrangement of claim 17, wherein the operation identification code is a key download command and the validation circuit is further adapted to update the time-varying decryption key stored in the validation circuit in response to validating the key download command.

20. The detection arrangement of claim 17, wherein the validation circuit is further adapted to update the time-varying decryption key by one of wired telephone connection, wireless telephone connection, wired internet access, and wireless internet access.

21. A method for securely communicating an operation identification code to a traffic location in an optical-communication traffic-preemption system, comprising:

encrypting the operation identification code using a time-varying encryption key;

transmitting light pulses from an optical emitter, wherein the light pulses represent the operation identification code that is encrypted;

receiving the light pulses at an optical detector situated at the traffic location;

decrypting using a time-varying decryption key the received operation identification code that is encrypted; and validating the operation identification code that is decrypted.

22. The method of claim 21, further comprising issuing a preemption command for a traffic light at the traffic location in response to the validation of the operation identification code that is decrypted.

23. The method of claim 22, wherein the operation identification code includes a vehicle identification code associated with a vehicle to which the optical emitter is mounted.

24. The method of claim 21, wherein the operation identification code is key download command and the time-varying decryption key is updated in response to the validation of the operation identification code that is decrypted.

25. The method of claim 21, further comprising logging the success and failure of the validation of the operation identification code that is decrypted.

26. A secure optical-communication traffic-preemption system, comprising:

means for encrypting an operation identification code using a time-varying encryption key;

means for transmitting light pulses from an optical emitter, wherein the light pulses represent the operation identification code that is encrypted;

means for receiving the light pulses at an optical detector situated at the traffic location;

means for decrypting using a time-varying decryption key the received operation identification code that is encrypted; and means for validating the operation identification code that is decrypted.

* * * * *